US008182881B2

(12) United States Patent
Strock et al.

(10) Patent No.: US 8,182,881 B2
(45) Date of Patent: May 22, 2012

(54) METHODS FOR REDUCING STRESS WHEN APPLYING COATINGS, PROCESSES FOR APPLYING THE SAME AND THEIR COATED ARTICLES

(75) Inventors: Christopher W. Strock, Kennebunk, ME (US); Richard M. Kabara, Cromwell, CT (US); John F. Corini, Barkhamsted, CT (US)

(73) Assignee: United Technologies Corporation, Hartford, CT (US)

( * ) Notice: Subject to any disclaimer, the term of this patent is extended or adjusted under 35 U.S.C. 154(b) by 652 days.

(21) Appl. No.: 12/343,537

(22) Filed: Dec. 24, 2008

(65) Prior Publication Data

US 2010/0159149 A1 Jun. 24, 2010

(51) Int. Cl.
*B05D 1/32* (2006.01)

(52) U.S. Cl. ..... 427/448; 427/446; 427/256; 427/282

(58) Field of Classification Search ..... 427/446, 427/448, 256, 282
See application file for complete search history.

(56) References Cited

U.S. PATENT DOCUMENTS

| | | | | |
|---|---|---|---|---|
| 3,528,861 | A | 9/1970 | Elam et al. | |
| 3,542,530 | A | 11/1970 | Talboom, Jr. et al. | |
| 3,649,225 | A | 3/1972 | Simmons, Jr. | |
| 3,676,085 | A | 7/1972 | Evans et al. | |
| 3,754,903 | A | 8/1973 | Goward et al. | |
| 4,078,922 | A | 3/1978 | Magyar et al. | |
| RE32,121 | E | 4/1986 | Gupta et al. | |
| 4,585,481 | A | 4/1986 | Gupta et al. | |
| 5,310,512 | A * | 5/1994 | Bigelow | 264/430 |
| 6,089,825 | A | 7/2000 | Walden et al. | |
| 6,352,264 | B1 | 3/2002 | Dalzell, Jr. et al. | |
| 2008/0085371 | A1 | 4/2008 | Gudlavalleti et al. | |

FOREIGN PATENT DOCUMENTS

| | | |
|---|---|---|
| CN | 2546294 Y | 4/2003 |
| CN | 1623678 A | 6/2005 |
| GB | 844276 A | 8/1960 |
| GB | 2251560 A | 7/1992 |

OTHER PUBLICATIONS

European Search Report for EP Patent Application No. 09252237.4, dated Nov. 18, 2010.

* cited by examiner

*Primary Examiner* — Frederick Parker
(74) *Attorney, Agent, or Firm* — Bachman & LaPointe, P.C.

(57) ABSTRACT

A process for applying a coating to an axially split component includes the steps of installing at least one expansion or contraction device to at least one half of an axially split component; expanding at least one half to change a radius and maintain a constant curvature of at least one masked piece; applying a coating to the half; and, removing at least one expansion or contraction device from at least one half.

24 Claims, 11 Drawing Sheets

METHODS FOR REDUCING STRESS WHEN APPLYING COATINGS, PROCESSES FOR APPLYING THE SAME AND THEIR COATED ARTICLES

GOVERNMENT RIGHTS

The United States Government may have certain rights in the invention pursuant to contract number N00019-02-C-3003 awarded by the United States Navy.

FIELD OF THE INVENTION

The invention relates to coatings and, more particularly, relates to reducing stress when thermal spray coatings to turbine engine components.

BACKGROUND OF THE INVENTION

When applying thermal spray coatings to the internal surfaces of axially split components such as fan casings, high energy thermal plasma spray techniques are commonly employed. During the coating processes, the high thermal energy and high coating application temperatures cause the residual stress in the coating and fan casing halves to distort. The resultant stress affects the quality and service life of the abradable coating. The thermal spray coating cracks and may spall or peel during use. As a result, cracked abradable coatings also affect the useful service life of the fan casing.

Therefore, there is a need for a process for applying a thermal spray coating upon an axially split component that reduces the stress experienced by the coating and component.

SUMMARY OF THE INVENTION

In accordance with one aspect of the present disclosure, a process for applying a coating to an axially split component, broadly comprises installing at least one expansion device to at least one half of an axially split component; expanding the at least one half to increase a radius and maintain a constant curvature of at least one half; applying at least one coating layer to at least a portion of at least one half; and removing at least one expansion device from at least one half.

In accordance with another aspect of the present disclosure, an expansion device for use in forming an axially split component broadly comprises a wedge-block shaped body; a first end; a second end disposed opposite the first end; and a tapered angle formed at an angle positively with respect to the inboard surface using the first end as a point of reference.

In accordance with yet another aspect of the present disclosure, a process for applying a coating to an axially split component broadly comprises installing at least one contraction device to at least one half of an axially split component; contracting at least one half to decrease a radius and maintain a constant curvature of at least one half; applying at least one coating layer to at least a portion of at least one half; and removing at least one contraction device from at least one half.

In accordance with still yet another aspect of the present disclosure, a contraction device for use in forming an axially split component broadly comprises a wedge-block shaped body; a first end; a second end disposed opposite the first end; and a tapered angle formed at an angle negatively with respect to the inboard surface using the first end as a point of reference.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Referring generally to FIGS. 1-8, an exemplary expansion device for use in applying coatings to axially split components is now described in detail. Although there are many examples of axially split components to select, the exemplary expansion device will be explained with regard to a split fan casing of a gas turbine engine.

Figure 1:
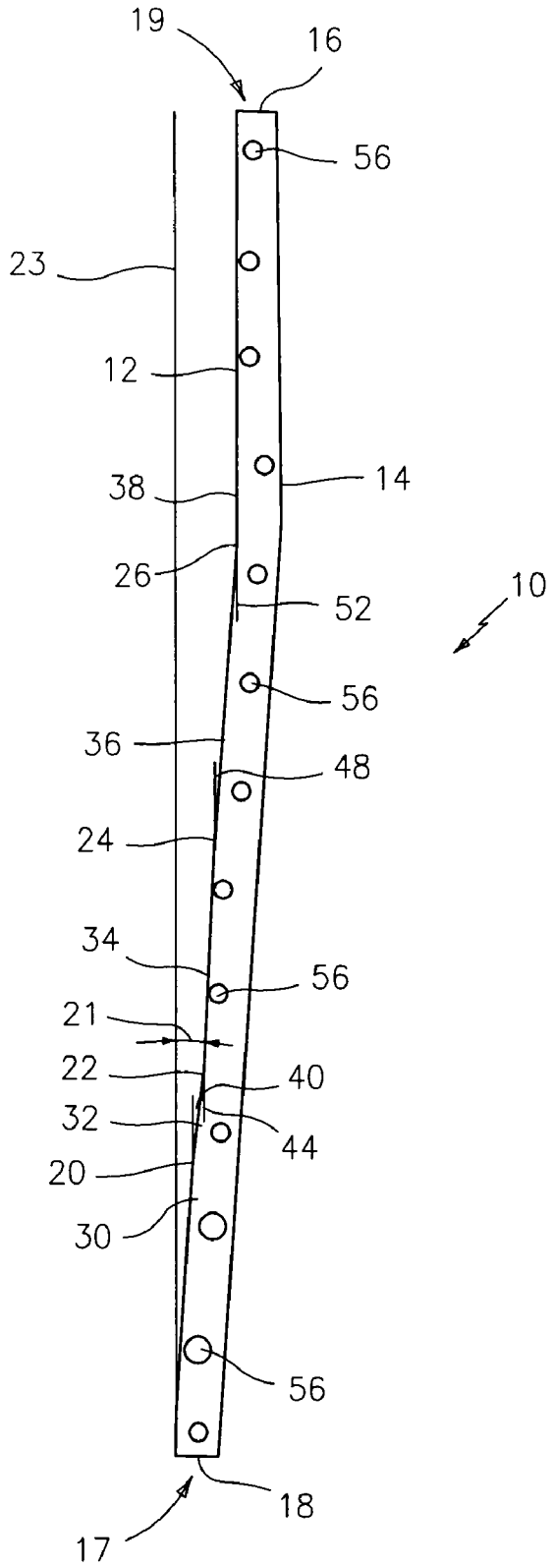
FIG. 1 is a representation of an exemplary expansion device described herein.
Figure 2:
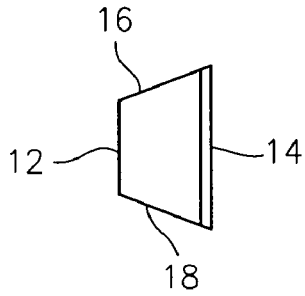
FIG. 2 is a cross-sectional view taken along lines A-A of the exemplary expansion device of FIG. 1.

Referring specifically now to FIGS. 1 and 2, an exemplary expansion device 10 is shown. The expansion device 10 may comprise a wedge-block shaped body (see cross-sectional view of FIG. 2) having an inboard surface 12 and an outboard surface 14 disposed opposite each other along with a first engagement surface 16 and a second engagement surface 18 disposed opposite each other. The respective surfaces 12, 14, 16 and 18 being connected together to form the wedge-block shaped body having a first end 17, a second end 19 and a conical angle 21 as shown in FIG. 2. A tapered angle may be formed at a positive angle with respect to the inboard surface 12.

In a split component that has multiple conical angles, the inboard surface 12 may include a plurality of intersection points 20, 22, 24 and 26 formed at the juncture of several portions of the inboard surface 12, for example, a first conical portion 30, a second conical portion 32, a third portion 34, a fourth portion 36 and a fifth portion 38. Each intersection point may also be associated with a change in angle, such that a first angle 40 may be formed about the inboard surface 12 at the first intersection point 20 of the first conical portion 30 and the second conical portion 32 using the first conical portion 30 as a point of reference. A second angle 44 may be formed inversely, that is, a negative angle as shown in FIG. 1, about the inboard surface 12 at a second intersection point 22 of the second conical portion 32 and the third portion 34 using the third portion 34 as a point of reference. A third angle 48 may be formed about the inboard surface 12 at a third intersection point 24 of the third portion 34 and the fourth portion 36 using the third portion 34 as a point of reference. A fourth angle 52 may be formed inversely about the inboard surface 12 at a fourth intersection point 26 of the fourth portion 36 and the fifth portion 38 using the fifth portion 38 as a point of reference. All of these angles are associated with a change in diameter of the split component along the axial length. The angle of the wedge remains constant, while the chord lengths of surfaces 12 and 14 vary proportionally to the diameter of the part at each axial location.

Generally, the inboard, first engagement and second engagement surfaces 12, 16 and 19 may possess dimensions that are approximated as an average of all the angles. The purpose of the inboard, first engagement and second engagement surfaces are to prevent the device from interfering with the coating process(es). Thus, the intersection points may be generalized collectively such that the shape and dimensions of the expansion device may change dependent upon the axially split component being coated. For example, the expansion device may exhibit a cylindrical shape or progress to exhibit a simple conical shape or progress to a complex set of dimensions as described above.

The first engagement surface 16 and second engagement surface 18 may include a plurality of apertures 56 disposed through the first engagement surface 16 to the second engagement surface 18 for receiving means for attachment 58 such as bolts and other devices, instrument, parts, etc., commonly used to secure two halves of an axially split component together.

The assembly is principally designed to proportionally expand the inner diameter of each half to induce a higher apparent stress to the axially split component, and thus relieving this higher apparent stress upon removal of the expansion devices. The arc length of each half of the axially split component may be expressed according to the following equation:

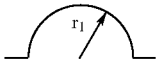

$$ARC=\Pi r_1 \quad \text{(Equation 1)}$$

where the ARC stands for the arc length of a half of the axially split component.

When the expansion devices are applied, the axially split component maintains an inner diameter that is larger, yet proportional to the original inner diameter of the assembled axially split component without the expansion devices. Each half of the axially split component expands to a larger radius while the arc length of each half remains constant. The expansion of each half of the axially split component may be expressed according to the following equation:

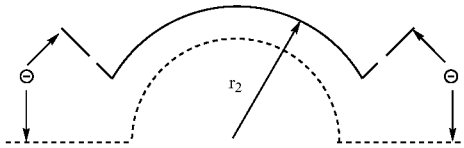

$$180^\circ \text{ arc length at } r_2=\Pi r_2=ARC+2\Theta r_2 \quad \text{(Equation 2)}$$

$$ARC=\Pi r_1$$

$$\Pi r_2=\Pi r_1+2\Theta r_2 \quad \text{(Equation 3)}$$

$$\Theta=\Pi(r_2-r_1)/2r_2 \quad \text{(Equation 4)}$$

The expansion devices force the axially split component to remain open throughout the thermal spray coating processes. The expansion devices minimize distortion typically experienced due to both the thermal spray bond coat and top coat layers while also promoting adhesion of both coatings to the axially split component by minimizing the stress in both the axially split component and coatings subsequent to releasing the part after the coating processes. The expansion devices are effective in reducing coating residual stresses for 1) tensile stresses on the inner surface of the case; or 2) compressive stresses on the outer surface of the case. The stresses being experience include, for example, (a) shrinkage of at least a portion of each half affected upon solidification of the molten coating materials; (b) shrinkage due to difference between particle temperature (of coating materials) and surface temperature of at least a portion of each half; and (c) the difference in coefficients of thermal expansion between the coating materials and the material of the axially split component; and (d) high velocity particle impact and a peening effect that imparts cold work and residual compressive stress as the coating is deposited.

When tightening the means for attachment during assembly, the bending motion being applied to the split flanges causes the two halves to maintain the larger proportional inner diameter. Typically, an alternating tightening sequence ensures the split flanges are assembled evenly. The thickness and inward angle of the pitch of the expansion device is directly proportional to the amount of deflection exhibited by the upper half and lower half. The expansion devices maintain a uniform angular expansion with the arc length of the expansion bars being proportional to the diameter of the assembly and original diameter of the axially split component. The inward angle of the pitch is the angle(s) of the engagement surface(s) of the expansion device. The inward angle of the pitch maintains a uniform curvature of the component while the radius of the assembly increases.

Figure 3:
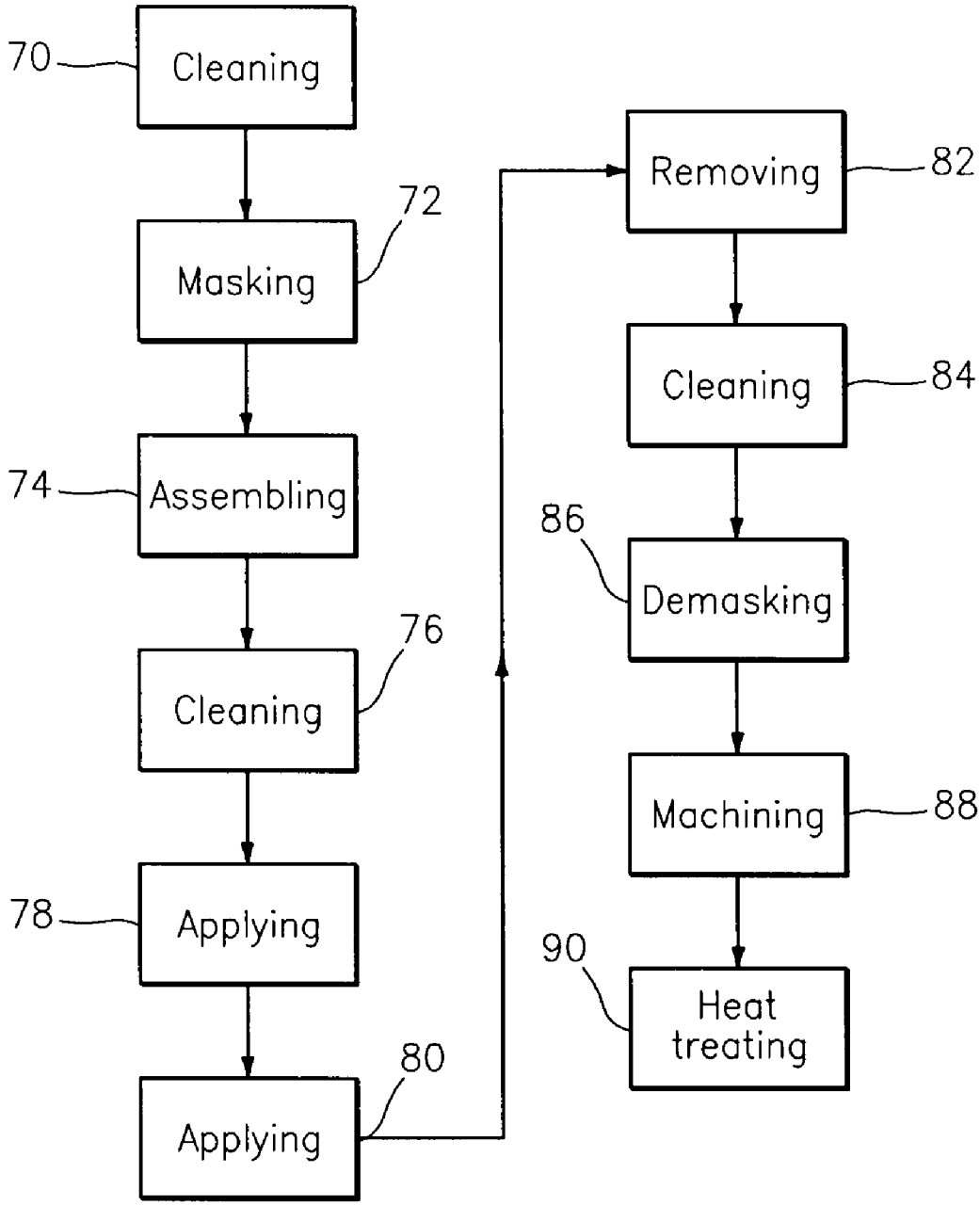
FIG. 3 is a flowchart illustrating an exemplary process for applying a coating to an axially split component.
Figure 4:
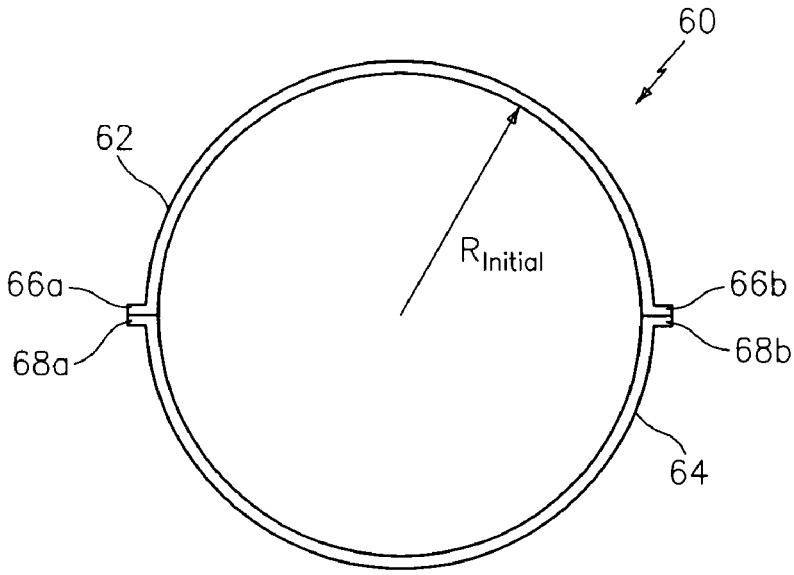
FIG. 4 is a cross-sectional view of an axially split component.
Figure 5:
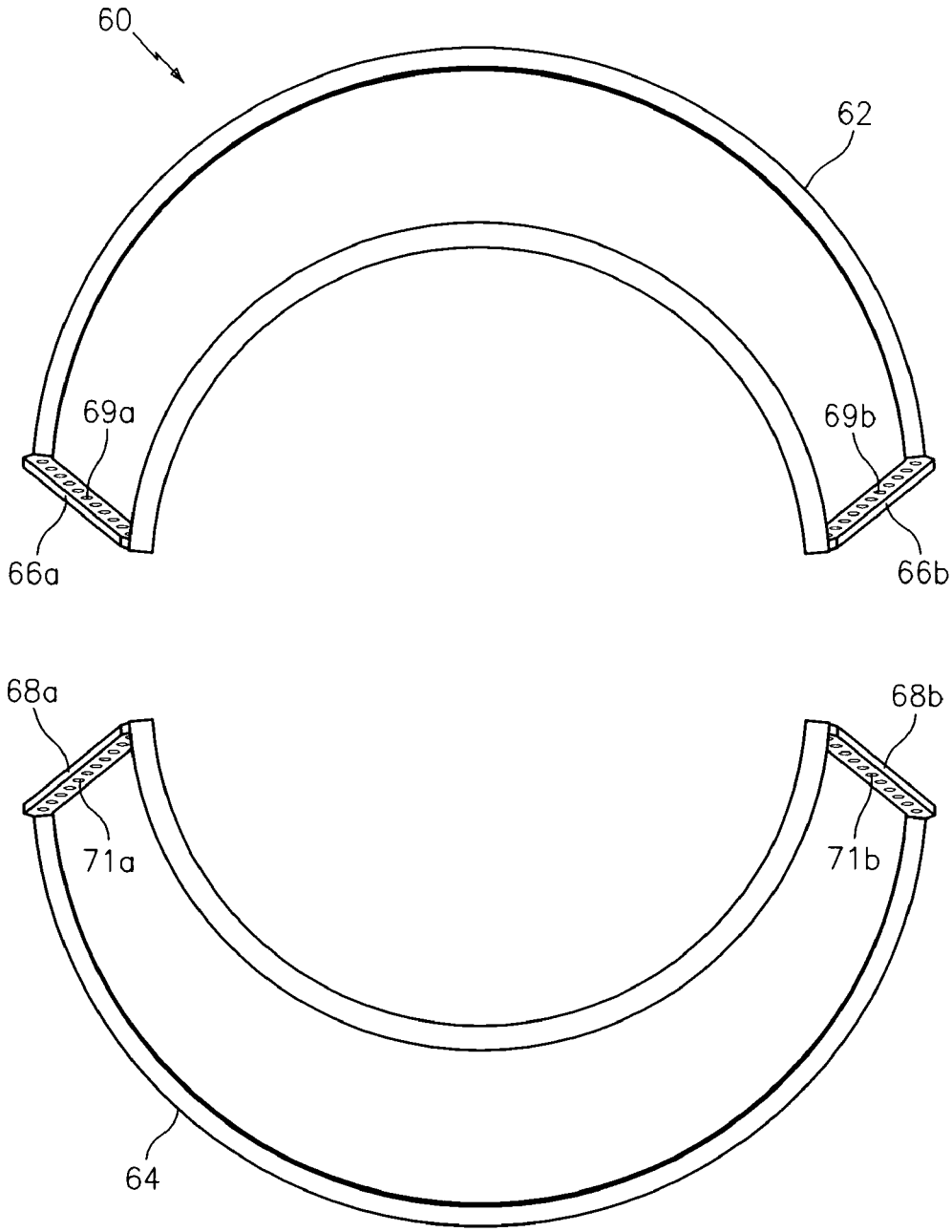
FIG. 5 is a perspective view of an upper half and a lower half of an axially split component.

A flowchart illustrating an exemplary process for installing the exemplary expansion device onto an axially split component to create an assembly for applying a coating upon an axially split component is shown in FIG. 3. Referring now to FIGS. 4 and 5, an axially split component 60 may include a first half 62, e.g., an upper half, having a pair of axial split flanges 66*a*, 66*b* and a second half 64, e.g., a lower half, having a pair of axial split flanges 68*a*, 68*b*. Each axial split flange 66*a*, 66*b*, 68*a*, 68*b* includes a plurality of apertures 69*a*, 69*b*, 71*a*, 71*b*. As shown in FIG. 4, the axially split component 60 may possess an original radius ($R_{Initial}$) at a resting position with the axial split flanges 66*a*, 66*b*, 68*a*, 68*b* in contact with one another and the two halves attached together.

In preparation for masking the component, the axially split component 60 of FIGS. 4 and 5 may undergo a cleaning process as known to one of ordinary skill in the art at step 70 of FIG. 3. After cleaning each half 62, 64, the cleaned halves 62, 64 may each be masked, if required, as known to one of ordinary skill in the art at step 72 of FIG. 3. Once masked, the upper half 62 and lower half 64 may be assembled to a pair of the aforementioned exemplary expansion devices 10*a* and 10*b* of FIGS. 1 and 2 at step 74 of FIG. 3.

Figure 6:
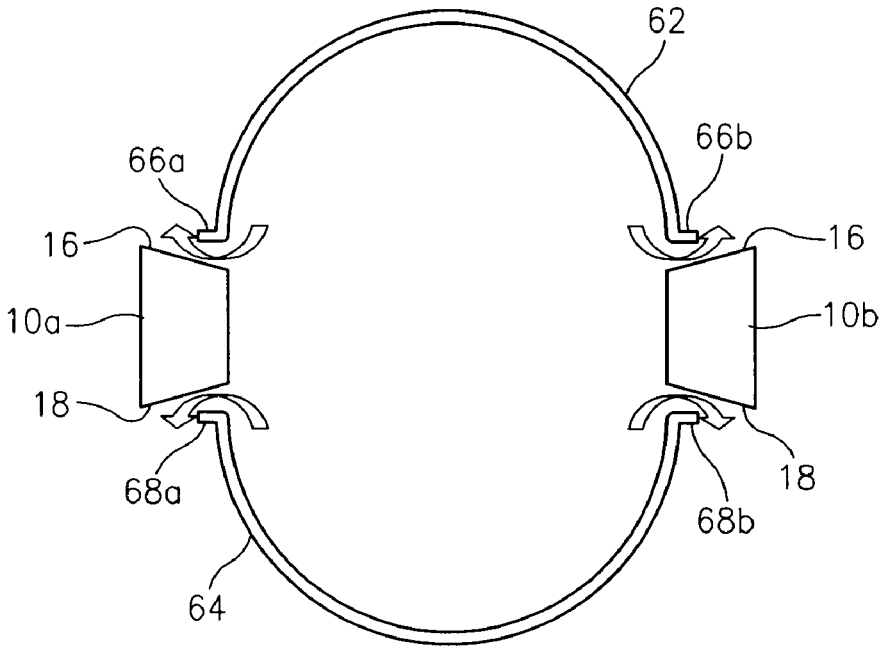
FIG. 6 is a cross-sectional view of a pair of expansion devices being disposed between each half of the axially split component and applying a bending moment upon each split flange of each half of the axially split component of FIG. 4.
Figure 7:
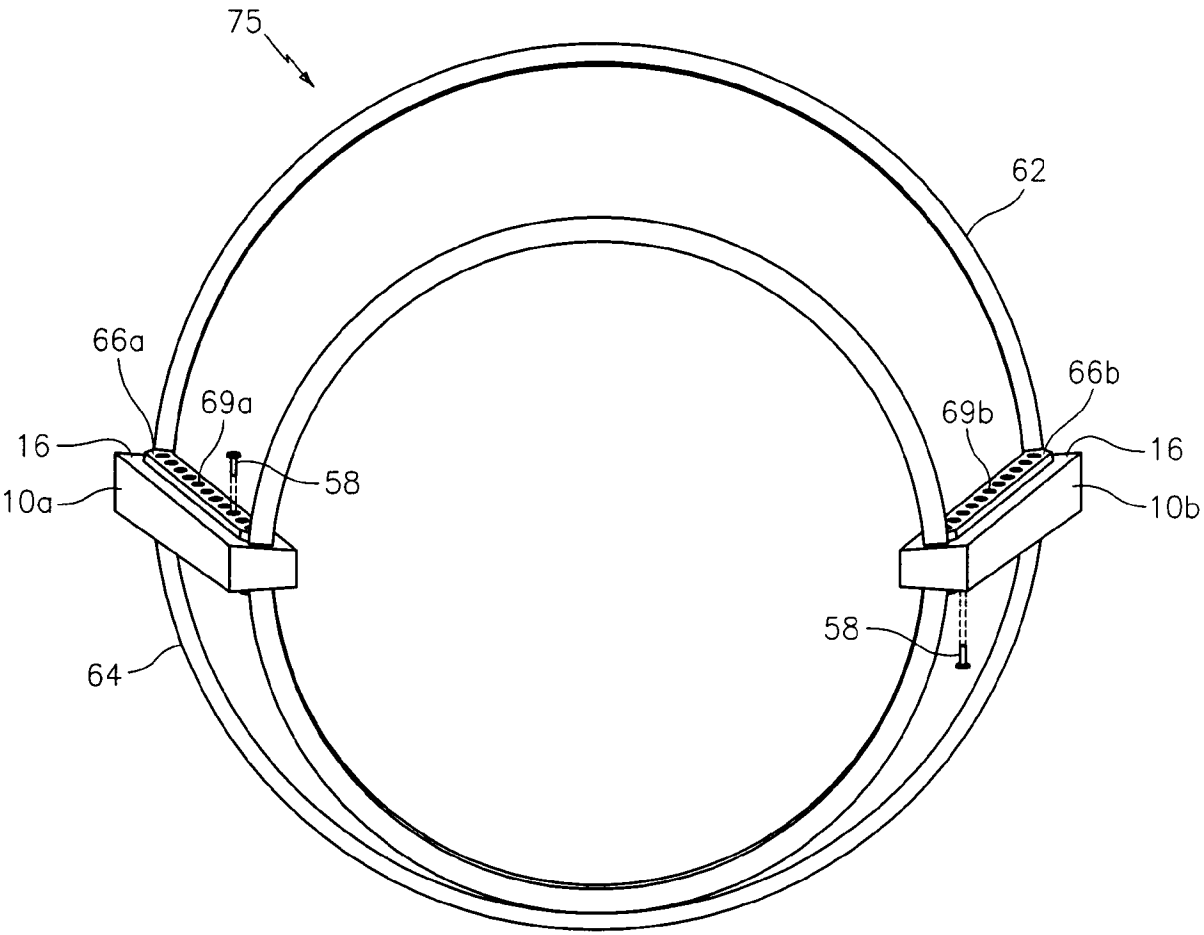
FIG. 7 is a perspective view of an assembly composed of the axially split component of FIG. 4 attached to a pair of the expansion devices of the present disclosure.
Figure 8:
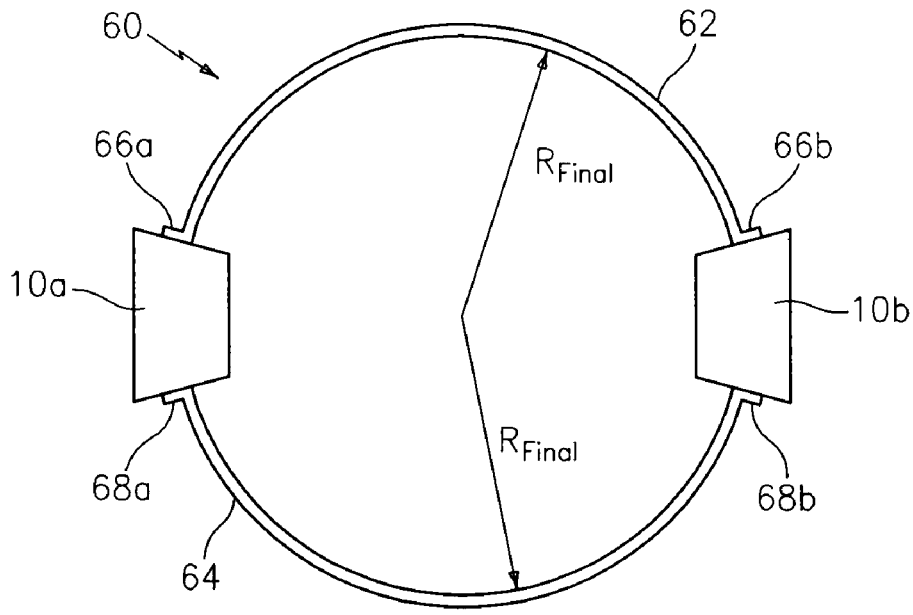
FIG. 8 is a cross-sectional view of the axially split component mounted to the expansion devices.

Referring now to FIGS. 6 and 7, the installation of expansion devices 10*a*, 10*b* begins by placing the split flanges 66*a*, 66*b* of upper half 62 in contact with the engagement surfaces 16 of expansion devices 10*a*, 10*b* and aligning the apertures 69*a*, 69*b* with the plurality of apertures 56. The split flanges 71*a*, 71*b* of lower half 64 may then be placed in contact with the engagement surfaces 18 of expansion devices 10*a*, 10*b* and aligning apertures 71*a*, 71*b* with the plurality of apertures 56. Referring now to FIGS. 7 and 8, once both halves 62, 64 are aligned with each expansion device 10*a*, 10*b* the means for attachment may be disposed through the apertures and secured in place to create a rigid assembly 75. As shown in FIG. 6, each split flange experiences a bending moment as each flange contacts an engagement surface of each expansion block. Each half of the axially split component then expands to achieve a larger radius ($R_{Final}$) (See FIG. 8) while maintaining a constant curvature.

After assembling the axially split component with the expansion devices, the assembly 75 may be cleaned in anticipation of being coated as known to one of ordinary skill in the art at step 76 of FIG. 3. Once cleaned, a bond coat material may be applied to at least a portion of the assembly 75 at step 78 of FIG. 3.

The bond coat material may comprise a formula MCrAlY. MCrAlY refers to known metal coating systems in which M denotes nickel, cobalt, iron, platinum or mixtures thereof; Cr denotes chromium; Al denotes aluminum; and Y denotes yttrium. MCrAlY materials are often known as overlay coatings because they are applied in a predetermined composition and do not interact significantly with the substrate during the deposition process. For some non-limiting examples of MCrAlY materials see U.S. Pat. No. 3,528,861 which describes a FeCrAlY coating as does U.S. Pat. No. 3,542,530. In addition, U.S. Pat. No. 3,649,225 describes a composite coating in which a layer of chromium is applied to a substrate prior to the deposition of a MCrAlY coating. U.S. Pat. No. 3,676,085 describes a CoCrAlY overlay coating while U.S. Pat. No. 3,754,903 describes a NiCoCrAlY overlay coating having particularly high ductility. U.S. Pat. No. 4,078,922 describes a cobalt base structural alloy which derives improved oxidation resistance by virtue of the presence of a combination of hafnium and yttrium. A preferred MCrAlY bond coat composition is described in U.S. Pat. No. Re. 32,121, which is assigned to the present Assignee and incorporated herein by reference, as having a weight percent compositional range of 5-40 Cr, 8-35 Al, 0.1-2.0 Y, 0.1-7 Si, 0.1-2.0 Hf, balance selected from the group consisting of Ni, Co and mixtures thereof. See also U.S. Pat. No. 4,585,481, which is also assigned to the present Assignee and incorporated herein by reference.

The bond coat material may also comprise Al, PtAl and the like, that are often known in the art as diffusion coatings. In addition, the bond coat material may also comprise Al, PtAl, MCrAlY as described above, and the like, that are often known in the art as cathodic arc coatings.

These bond coat materials may be applied by any method capable of producing a dense, uniform, adherent coating of the desired composition, such as, but not limited to, an overlay bond coat, diffusion bond coat, cathodic arc bond coat, etc. Such techniques may include, but are not limited to, diffusion processes (e.g., inward, outward, etc.), low pressure plasma-spray, air plasma-spray, sputtering, cathodic arc, electron beam physical vapor deposition, high velocity plasma spray techniques (e.g., HVOF, HVAF), combustion processes, wire spray techniques, laser beam cladding, electron beam cladding, etc.

The particle size for the bond coat may be of any suitable size, and in embodiments may be between about 15 microns (0.015 mm) and about 100 microns (0.100 mm) with a mean particle size of about 45 microns (0.045 mm). The bond coat may be applied to any suitable thickness, and in embodiments may be about 3 mils (0.076 mm) to about 12 mils (0.305 mm) thick. In some embodiments, the thickness may be about 6 mils (0.152 mm) to about 7 mils (0.178 mm) thick.

Once the bond coat is first applied, a thermal spray coating material may then be applied upon at least a portion of the bond coat layer and/or a portion of the assembly 75 at step 80 of FIG. 3. Suitable thermal spray coating material may include any suitable materials as known to one of ordinary skill in the art such as porous and or filled metallic materials including aluminum, nickel and copper alloys sprayed alone or with fillers such as polymers, organic and inorganic materials that may include Lucite, polyester, polyvinyl alcohol, graphite, hexagonal boron nitride, bentonite, combinations comprising at least one of the foregoing, and the like. For example, an exemplary thermal spray coating material may be an aluminum silicon alloy filled with Lucite as disclosed in U.S. Pat. No. 6,352,264 to Dalzell et al. and U.S. Pat. No. 6,089,825 to Walden et al., both assigned to United Technologies Corporation.

Once both coatings have been applied, the means for attachment 58 may be removed in order to detach each half 62, 64 from each expansion device 10*a*, 10*b* in step 82. Any one of a number of suitable methods for removing the means for attachment 58 may be utilized as known to one of ordinary skill in the art.

After removing the expansion devices 10*a*, 10*b* and disassembling the assembly 75, each resultant coated half 62, 64 may be cleaned as known to one of ordinary skill in the art at step 84 of FIG. 3. Once cleaned, each cleaned, coated half 62, 64 may be demasked using any one of a number of techniques known to one of ordinary skill in the art at step 86 of FIG. 3. Afterwards, the axially split component 60 may be assembled and machined to its intended specifications at step 88 of FIG. 3. Once machined, the axially split component 60 may undergo heat treatment at step 90 to remove fugitive coating constituents, modify the coating structure, or relieve residual coating stresses that may be present. Any number of heat treatment techniques may be utilized as known to one of ordinary skill in the art.

Figure 9:
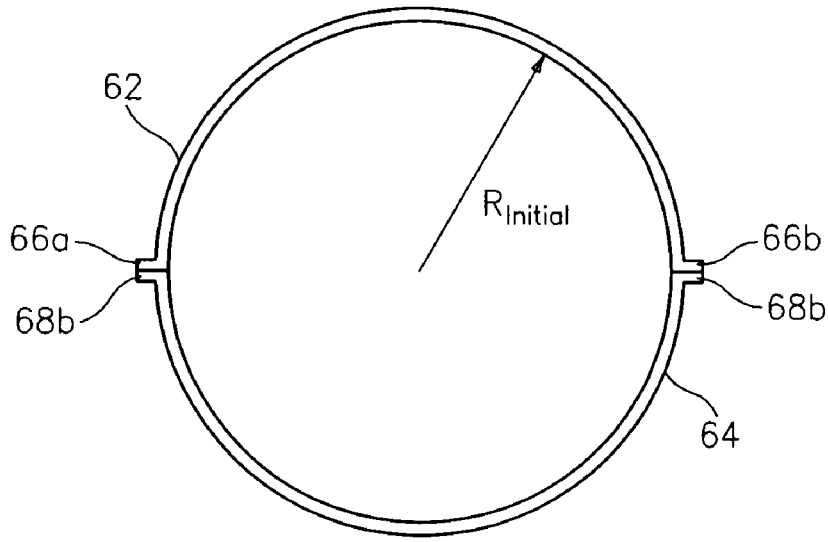
FIG. 9 is a cross-sectional view of an axially split component.
Figure 10:
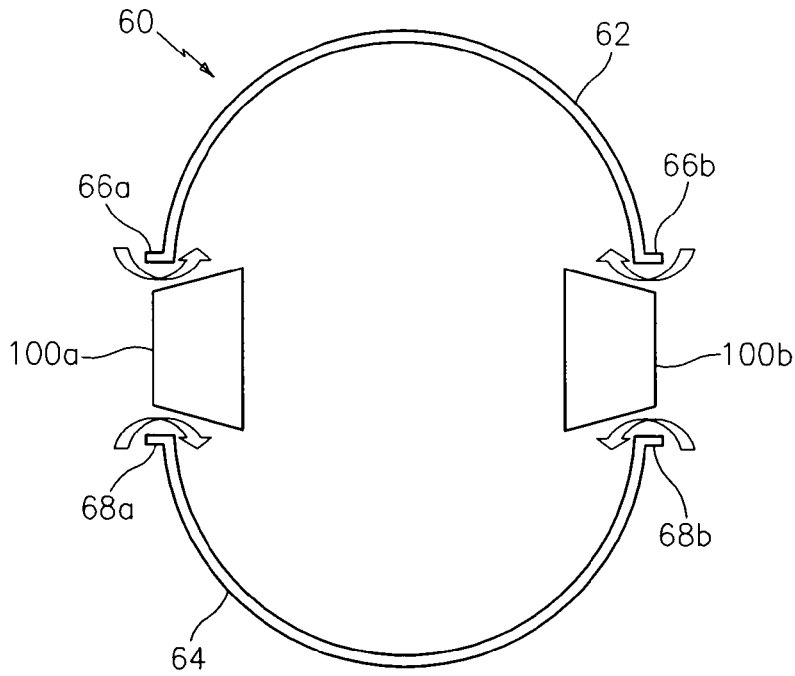
FIG. 10 is a cross-sectional view of a pair of contraction devices being disposed between each half of the axially split component and applying a bending moment upon each split flange of each half of the axially split component of FIG. 9.
Figure 11:
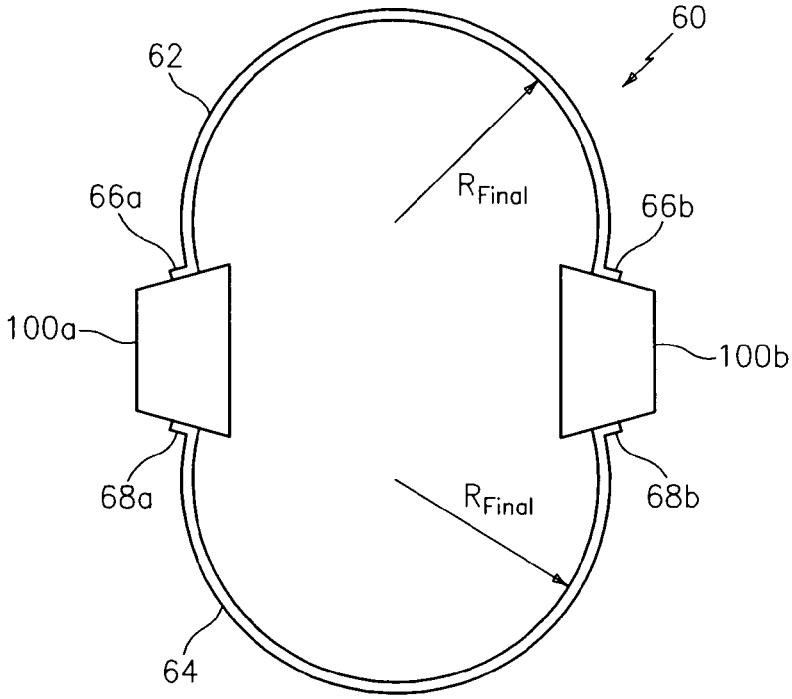
FIG. 11 is a cross-sectional view of the axially split component mounted to the contraction devices.
Figure 12:
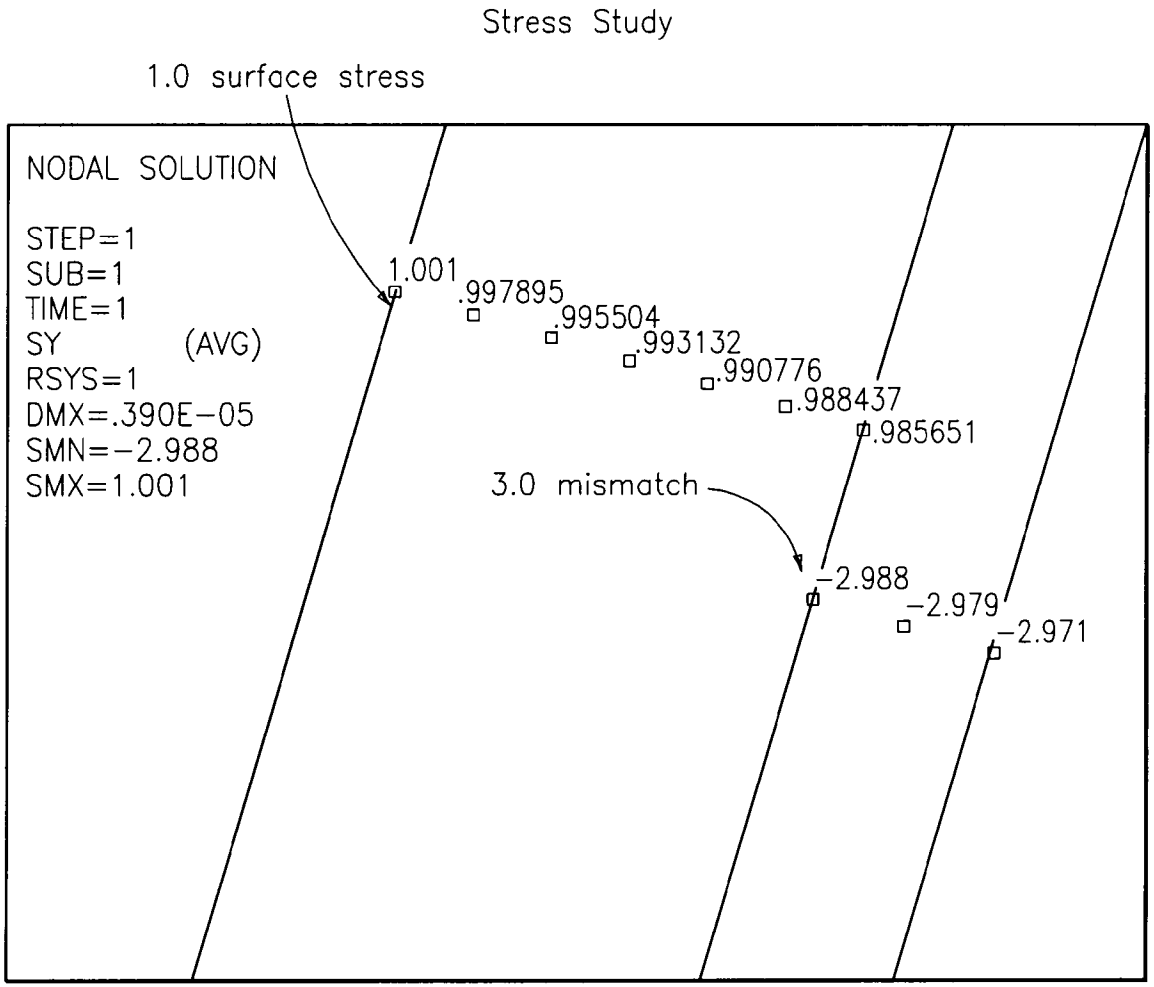
FIG. 12 is a stress study of a first run of Table 1.
Figure 13:
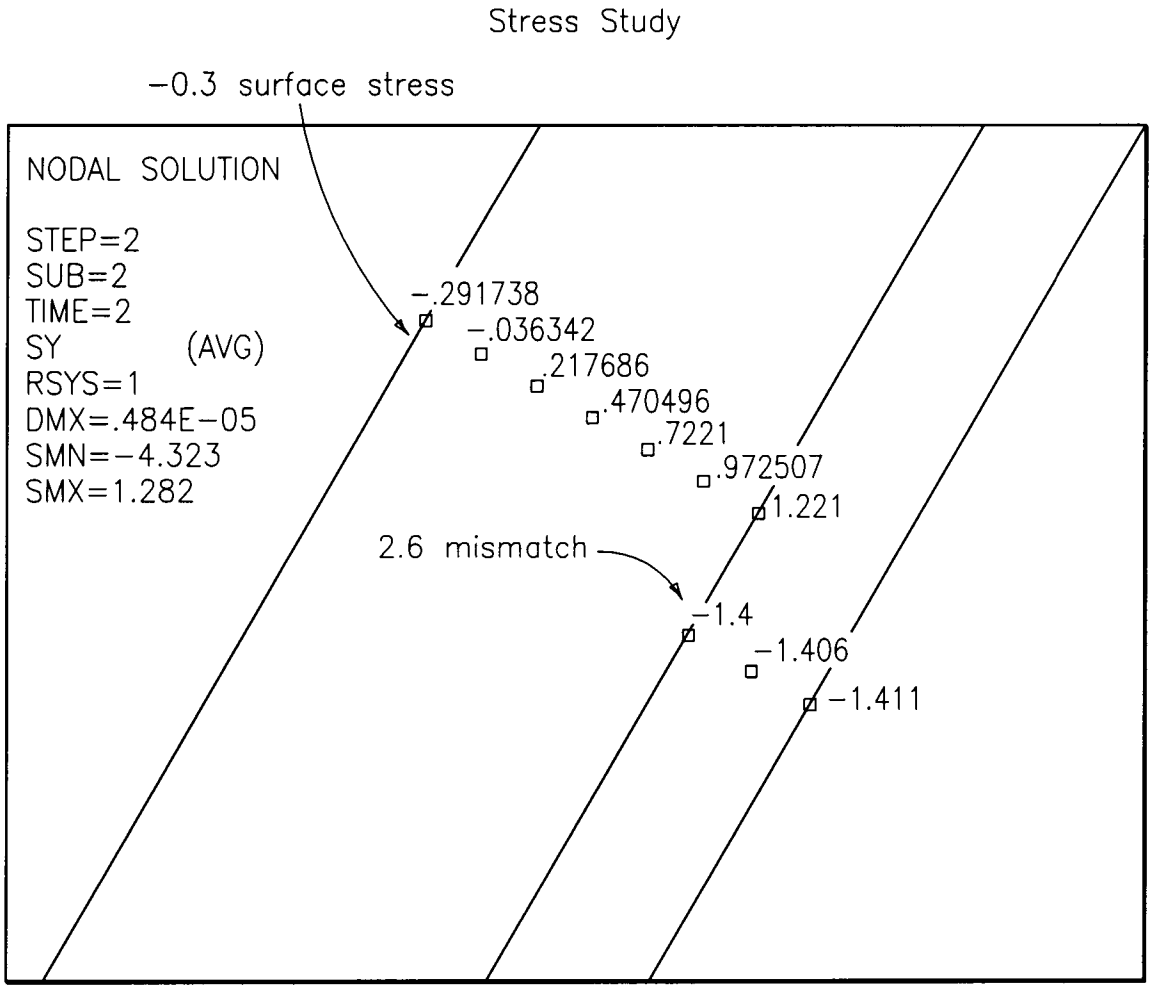
FIG. 13 is a stress study of a second run of Table 1.
Figure 14:
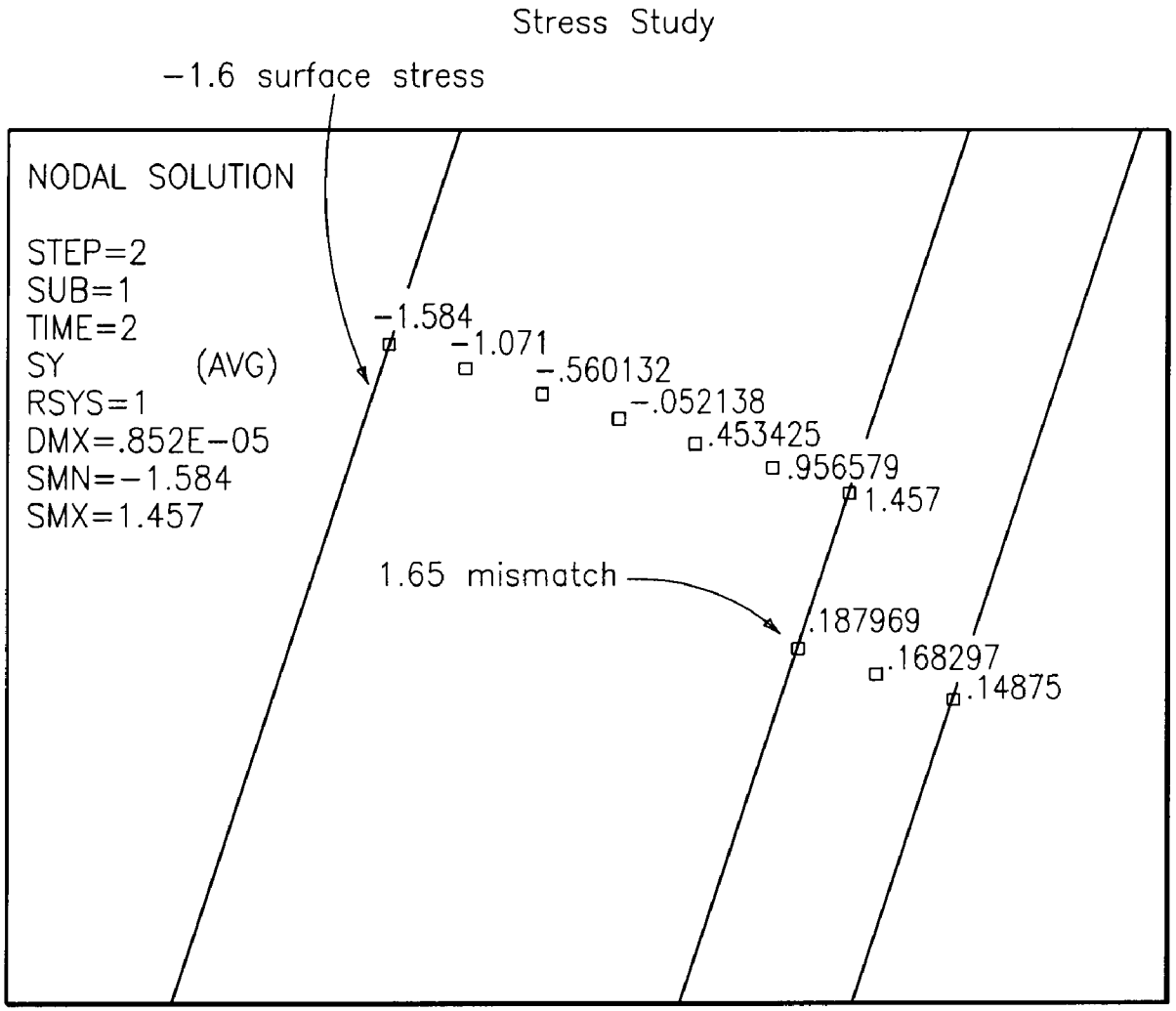
FIG. 14 is a stress study of a third run of Table 1.
Figure 15:
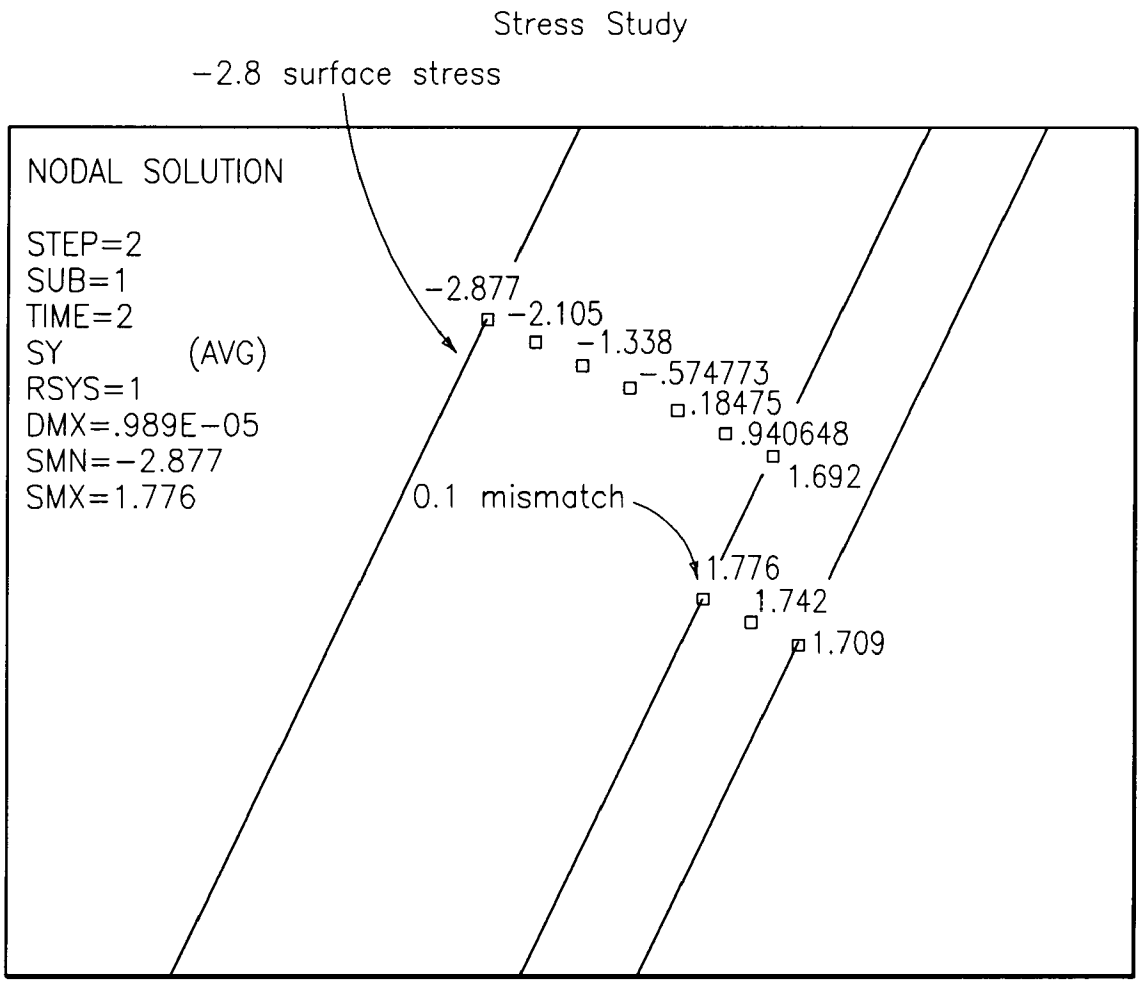
FIG. 15 is a stress study of a fourth run of Table 1.

In an alternative embodiment, the expansion device may also be employed as a contraction device as shown in FIGS. 9-11. Contraction devices 100*a*, 100*b* may be disposed in contact with the split flanges 66*a*, 66*b*, 68*a*, 68*b* as described above such that a tapered angle may be formed at a negative angle with respect to the inboard surface 12. The resultant assembly containing the contraction devices causes each half of the axially split component to possess a smaller radius yet maintain a constant curvature.

The assembly employing the contraction devices is principally designed to proportionally contract the inner diameter of each half to also induce a higher apparent stress to the axially split component, and thus relieve this higher apparent stress upon removal of the contraction devices. The arc length of each half of the axially split component may be expressed according to the following equation:

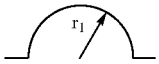

$$ARC=\Pi r_1 \quad \text{(Equation 5)}$$

where the ARC stands for the arc length of a half of the axially split component.

When the contraction devices are applied, the axially split component maintains an inner diameter that is smaller, yet proportional to the original inner diameter of the assembled axially split component without the contraction devices. Each half of the axially split component contracts to a smaller radius while the arc length of each half remains constant. The contraction of each half of the axially split component may be expressed according to the following equation:

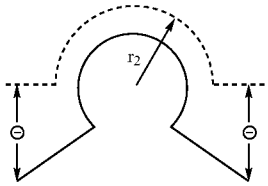

$$180^\circ \text{ arc length at } r_2=\Pi r_2=ARC-2\Theta r_2 \quad \text{(Equation 6)}$$

$$ARC=\Pi r_1$$

$$\Pi r_2=\Pi r_1-2\Theta r_2 \quad \text{(Equation 7)}$$

$$\Theta=\Pi(r_1-r_2)/2r_2 \quad \text{(Equation 8)}$$

The contraction devices force the axially split component to remain at a tighter curvature throughout the coating processes such as applying tensile stressed coating on the outer diameter or compressively stressed coatings on the inner diameter. The contraction devices minimize distortion typically experienced due to both the thermal spray bond coat and top coat layers while also promoting adhesion of both coatings to the axially split component by minimizing the stress in both the axially split component and coatings subsequent to releasing the axially split component after completing the coating processes. The contraction devices are effective in reducing coating residual stress for 1) compressive stresses on the inner surface of the case or 2) tensile stresses on the outer surface of the case. The stresses being experience include, for example, (a) shrinkage of at least a portion of each half affected upon solidification of the molten coating materials; (b) shrinkage due to difference between particle temperature (of coating materials) and surface temperature of at least a portion of each half; and (c) the difference in coefficients of thermal expansion between the coating materials and the material of the axially split component; and (d) high velocity particle impact and a peening effect imparts cold work and residual compressive stress as the coating is deposited.

When tightening the means for attachment during assembly, the bending motion being applied to the split flanges causes the two halves to maintain the smaller proportional inner diameter. Typically, an alternating tightening sequence ensures the split flanges are assembled evenly. The thickness and inward angle of the pitch of the contraction device is directly proportional to the amount of inflection exhibited by the upper half and lower half. The contraction devices maintain a uniform angular expansion with the arc length of the expansion bars being proportional to the diameter of the assembly and original diameter of the axially split component. The outward angle of the pitch is the angle(s) of the engagement surface(s) of the contraction device. The outward angle of the pitch maintains a uniform curvature of the component while the radius of the assembly decreases.

EXPERIMENTAL SECTION

A generic fan casing shown in FIGS. 12-15 was modeled in a constrained open to larger diameter by 1, 2, and 3 inches using a pair of expansion devices (not shown). The constrained fan casing was then simulated to have coating applied in the constrained lager condition and then returned to nominal diameter for stress analysis. The results of the stress analysis are shown below in Table 1. A value for the coating/fan case interface mismatch stress at nominal diameter of near zero is associated with a neutral stress condition and a reduced tendency for spallation.

TABLE 1

| Pre-Spray Stretch (inches) | Case surface stress while coating | Coating/Case Interface mismatch at nominal diameter | Coating Surface Tensile Stress |
|---|---|---|---|
| No stretch | 0.0 | 3.0 | 1.0 |
| +1.0 | 0.8 | 2.6 | −0.3 |
| +2.0 | 1.6 | 1.7 | −1.6 |
| +3.0 | 3.5 | 0.1 | −2.8 |

First Run

A fan case half was simulated while constrained in a nominal position, that is, no diameter expansion. The observed case surface stress was 0 and coating/case interface mismatch was 3.0. The coating surface tensile stress was normalized to 1.0 (See FIG. 12).

Second Run

A fan case half was simulated while constrained to nominal diameter +1.0 inches. The observed case surface stress was 0.8 and coating/case interface mismatch was 2.6. The coating surface stress was normalized. However, the observed coating surface tensile stress was −0.3 (See FIG. 13).

Third Run

A fan case half was simulated while constrained to nominal diameter +2.0 inches. The observed case surface stress was 1.6 and coating/case interface mismatch was 1.7. The coating surface stress was normalized. However, the observed coating surface tensile stress was −1.6 (See FIG. 14).

Fourth Run

A fan case half was simulated while nominal diameter +3.0 inches. The observed case surface stress was 3.5 and coating/case interface mismatch was 0.1. The coating surface stress was normalized. However, the observed coating surface tensile stress was −2.8 (See FIG. 15).

Based upon these reported results, the use of the expansion devices lowered the stress discontinuity at coating/case interface to near zero at the final condition of +3.0 inches; lowered the tensile stress due to the coating process transitions to compressive stress on the inner surface of the coating; and, indicated that inner surface cracking and delamination would be minimalized.

The use of the expansion device of the present disclosure permits one of ordinary skill in the art to exceed known coating parameter limitations. A thicker abradable coating may be applied without experiencing typically related higher coating stresses. In the alternative, a more durable abradable coating of standard thickness as known to one of ordinary skill in the art may be applied. The resultant abradable coating of standard thickness is more durable due to the reduced stress state of the coating in its service condition. As a result, the abradable coating of standard thickness can withstand more rigorous environmental conditions during operation.

One or more embodiments of the present invention have been described. Nevertheless, it will be understood that various modifications may be made without departing from the spirit and scope of the invention. Accordingly, other embodiments are within the scope of the following claims.

What is claimed is:

1. A process for applying a coating to an axially split component, the process comprising:

installing at least one expansion device to at least one half of an axially split component;

expanding said at least one half to increase a radius and maintain a constant curvature of said at least one half;

applying at least one coating layer to at least a portion of said at least one half; and removing said at least one expansion device from said coated at least one half.

2. The process of claim 1, wherein the installing comprises attaching said at least one expansion device to at least one split flange of said at least one half of said axially split component with attachment means.

3. The process of claim 2, wherein the installing comprises the steps of:

providing a first said expansion device and a second said expansion device;

providing said axially split component;

attaching a first split flange of said upper half of said fan casing to a first engagement surface of said first expansion device;

attaching a second split flange of said upper half to a first engagement surface of a second expansion device;

attaching a first split flange of said lower half of said fan casing to a second engagement surface of said first expansion device; and attaching a second split flange of said lower half to a second engagement surface of said second expansion device.

4. The process of claim 1, further comprising the step of cleaning said at least one half prior to applying said at least one coating layer.

5. The process of claim 1, further comprising the steps of:

cleaning at least one half of said axially split component; and masking at least a portion of at least one cleaned half prior to installing said at least one expansion device.

6. The process of claim 5, further comprising the steps of:

cleaning at least one half after applying said at least one coating layer;

demasking the coated at least one half;

machining the demasked at least one half; and heat treating the machined at least one half.

7. A process for applying a coating to an axially split component, comprising:

installing at least one expansion device to at least one half of an axially split component;

expanding said at least one half to increase a radius and maintain a constant curvature of said at least one half, during the expanding, the at least one half experiencing a bending moment;

applying at least one coating layer to at least a portion of said at least one half; and removing said at least one expansion device from said coated at least one half.

8. The process of claim 7 wherein the expansion device comprises:

a wedge-block shaped body;

a first end;

a second end disposed opposite said first end; and a tapered angle formed at an angle positively with respect to said inboard surface using said first end as a point of reference.

9. The process of claim 8, wherein said wedge-block shaped body comprises an inboard surface having a plurality of intersection points, an outboard surface disposed opposite said inboard surface, a first engagement surface disposed opposite a second engagement surface, said first engagement surface and said second engagement surface having a means for engaging.

10. The process of claim 9, the expansion device further comprising means for engagement including at least one aperture disposed through said first engagement surface and said second engagement surface, during said installing said at least one aperture receiving a means for attachment.

11. The process of claim 9, wherein said plurality of intersection points further comprise:

a first intersection point having a first angle formed about said inboard surface at a first intersection of a first conical portion of said inboard surface and a second conical portion of said inboard surface using said first conical portion as a point of reference;

a second intersection point having a second angle formed inversely about said inboard surface at a second intersection point of said second conical portion and a third portion of said inboard surface using said third portion as a point of reference;

a third intersection point having a third angle formed about said inboard surface at a third intersection point of said third portion and a fourth portion of said inboard surface using said third portion as a point of reference; and a fourth intersection point having a fourth angle formed inversely about said inboard surface at a fourth intersection point of said fourth portion and a fifth portion of said inboard surface using said fifth portion as a point of reference.

12. A process for applying a coating to an axially split component, the process comprising:

installing at least one contraction device to at least one half of an axially split component wherein said axially split component comprises a fan casing, and said at least one piece comprises an upper half of said fan casing or a lower half of said fan casing;

contracting said at least one half to decrease a radius and maintain a constant curvature of said at least one half;

applying at least one coating layer to at least a portion of said at least one half; and removing said at least one contraction device from said coated at least one half.

13. The process of claim 12, wherein installing comprises attaching said at least one contraction device to at least one split flange of said at least one half of said axially split component with attachment means.

14. The process of claim 13, wherein installing comprises the steps of:

providing a first said contraction device and a second said contraction device;

attaching a first split flange of said upper half of said fan casing to a first engagement surface of said first contraction device;

attaching a second split flange of said upper half to a first engagement surface of a second contraction device;

attaching a first split flange of said lower half of said fan casing to a second engagement surface of said first contraction device; and attaching a second split flange of said lower half to a second engagement surface of said second contraction device.

15. The process of claim 12, further comprising the step of cleaning said at least one half prior to applying said at least one coating layer.

16. The process of claim 12, further comprising the steps of:

cleaning at least one half of said axially split component; and masking at least a portion of at least one cleaned half prior to installing said at least one contraction device.

17. The process of claim 16, further comprising the steps of:

cleaning the at least one half after applying said at least one coating layer;

demasking the coated at least one half;

machining the demasked at least one half; and heat treating the machined at least one half.

18. A process for applying a coating to an axially split component, comprising:

installing at least one contraction device to at least one half of an axially split component wherein said axially split component comprises a fan casing, and said at least one piece comprises an upper half of said fan casing or a lower half of said fan casing;

contracting said at least one half to decrease a radius and maintain a constant curvature of said at least one half, during the expanding, the at least one half experiencing a bending moment;

applying at least one coating layer to at least a portion of said at least one half; and removing said at least one contraction device from said coated at least one half.

19. The process of claim 18 wherein the contraction device comprises:

a wedge-block shaped body;

a first end;

a second end disposed opposite said first end; and a tapered angle formed at an angle negatively with respect to said inboard surface using said first end as a point of reference.

20. The process of claim 19, wherein said wedge-block shaped body comprises an inboard surface having a plurality of intersection points, an outboard surface disposed opposite said inboard surface, a first engagement surface disposed opposite a second engagement surface, said first engagement surface and said second engagement surface having a means for engaging.

21. The process of claim 20, the contraction device further comprising means for attachment including at least one aperture disposed through said first engagement surface and said second engagement surface, during said installing said at least one aperture receiving a means for attachment.

22. The process of claim 20, wherein said plurality of intersection points further comprise:

a first intersection point having a first angle formed about said inboard surface at a first intersection of a first conical portion of said inboard surface and a second conical portion of said inboard surface using said first conical portion as a point of reference;

a second intersection point having a second angle formed inversely about said inboard surface at a second intersection point of said second conical portion and a third portion of said inboard surface using said third portion as a point of reference;

a third intersection point having a third angle formed about said inboard surface at a third intersection point of said third portion and a fourth portion of said inboard surface using said third portion as a point of reference; and a fourth intersection point having a fourth angle formed inversely about said inboard surface at a fourth intersection point of said fourth portion and a fifth portion of said inboard surface using said fifth portion as a point of reference.

23. A process for applying a coating to an axially split component, comprising:

installing at least one expansion device to at least one half of an axially split component;

expanding said at least one half to increase a radius and maintain a constant curvature of said at least one half;

applying at least one coating layer to at least a portion of said at least one half;

removing said at least one expansion device from said coated at least one half;

cleaning at least one half of said axially split component;

masking at least a portion of at least one cleaned half prior to installing said at least one expansion device;

cleaning at least one half after applying said at least one coating layer;

demasking the coated at least one half;

machining the demasked at least one half; and heat treating the machined at least one half.

24. A process for applying a coating to an axially split component, the process comprising:

installing at least one contraction device to at least one half of an axially split component wherein said axially split component comprises a fan casing, and said at least one piece comprises an upper half of said fan casing or a lower half of said fan casing;

contracting said at least one half to decrease a radius and maintain a constant curvature of said at least one half;

applying at least one coating layer to at least a portion of said at least one half;

removing said at least one contraction device from said coated at least one half;

cleaning at least one half of said axially split component;

masking at least a portion of at least one cleaned half prior to installing said at least one contraction device;

cleaning the at least one half after applying said at least one coating layer;

demasking the coated at least one half;

machining the demasking at least one half; and heat treating the machined at least one half.

* * * * *